United States Patent [19]

Wuerthele

[11] Patent Number: 4,697,801

[45] Date of Patent: Oct. 6, 1987

[54] PARALLEL VICE

[75] Inventor: Adolf Wuerthele, Guntershausen, Switzerland

[73] Assignee: Gressel AG, Aadorf, Switzerland

[21] Appl. No.: 863,217

[22] Filed: May 14, 1986

[30] Foreign Application Priority Data

May 14, 1985 [DE] Fed. Rep. of Germany ... 8514223[U]

[51] Int. Cl.[4] ..... B25B 1/10

[52] U.S. Cl. ..... 269/100; 269/208; 269/247

[58] Field of Search ..... 269/97, 208, 240, 246–247, 269/250–253, 100

[56] References Cited

U.S. PATENT DOCUMENTS

| | | | |
|---|---|---|---|
| 1,265,218 | 7/1918 | Long | 269/246 X |
| 1,538,500 | 5/1925 | Aubard | 269/246 X |
| 1,799,474 | 4/1931 | McChesney | 269/97 |
| 3,675,916 | 7/1972 | Kartasuk et al. | 269/252 X |
| 4,330,113 | 5/1982 | Ferdinand et al. | 269/97 X |
| 4,415,149 | 11/1983 | Rees | 269/246 X |

FOREIGN PATENT DOCUMENTS

| | | | |
|---|---|---|---|
| 57106 | 6/1891 | Fed. Rep. of Germany | 269/100 |
| 808580 | 7/1951 | Fed. Rep. of Germany | 269/247 |

*Primary Examiner*—Frederick R. Schmidt
*Assistant Examiner*—Steven P. Schad
*Attorney, Agent, or Firm*—Flynn, Thiel, Boutell and Tanis

[57] ABSTRACT

A forwardly opening parallel vice has a housing (1) which can be fixed to a workbench (3) and which carries the stationary clamping jaw (2) and which is provided with a quadrangular guide structure. Displaceable in the guide structure is a hollow slider which is supported with a plurality of guide surfaces (13) on the guide tracks (11) of the guide structure and which carries the movable clamping jaw (14). Of a screw spindle-nut assembly (15-17) which is provided in the slider (12), one part (15, 16) is mounted rotatably and axially immovably in the slider (12) while the other part (17) is fixed to the housing (1). The slider (12) is of square cross-section and the axis (A) of the screw spindle is arranged precisely at the center of the square cross-section. In that arrangement the guide surfaces (13) which are provided at the four sides of the slider (12) and the guide tracks (11) of the housing (1), which co-operate with said guide surfaces, form tangents to a common circle (k) whose centerpoint is the axis (A) of the screw spindle.

11 Claims, 6 Drawing Figures

PARALLEL VICE

FIELD OF THE INVENTION

The invention relates to a forwardly opening parallel vice comprising a housing which can be fixed to a workbench or the like and which carries the stationary clamping jaw and which has a quadrangular guide means, and a hollow slider which is displaceable in the guide means and which bears with a plurality of guide surfaces against the guide tracks of the quadrangular guide means and carries the movable clamping jaw, and a screw spindle nut assembly which is provided in the slider, of which one part is mounted rotatably and axially immovably in the slider and the other part is fixed to the housing.

BACKGROUND OF THE INVENTION

Parallel vices of that kind, with a quadrangular guide means, in accordance with DIN 5115, are known in a wide range of constructions. The housing generally has an opening of rectangular cross-section, the inner surfaces defining that opening forming the guide tracks for the slider which is also of rectangular cross-section. The slider itself is generally of a downwardly open, substantially U-shaped cross-section, while disposed in the interior of the slider is a screw spindle which is mounted rotatably but axially immovably at the forward end of the slider. In addition, a nut is connected to the base plate of the housing, the nut engaging from below into the slider while the screw spindle can be screwed in the nut. The maximum width of clamping of the known parallel vices is limited by the length of the slider and is always shorter than the slider itself as, when the vice is in a completely open condition, the slider must still engage over a sufficient length into the guide means of the housing. In most of the known parallel vices, the housing comprises a bottom portion and a top portion so that the guide tracks of the quandrangular guide means, which are provided in the housing, can be easily machined. However the production of the two housing portions and precise machining of the connecting surfaces involves an additional manufacturing cost. There are however also vices in which the housing is of a onepart construction but in that case the guide surfaces of the guide means are difficult to machine, particularly when a higher degree of accuracy in respect of the vice is required. The slider which is of a cross-section that is open at one side also has a low level of stiffness.

The invention is based on the problem of providing a forwardly opening parallel vice of the kind set forth in the opening part of this specification, which is easy to produce and which can be used like a conventional vice, in which however if necessary the width of clamping can be increased as desired beyond the normal displaceability of the slider. The invention further seeks to provide that the slider enjoys increased stiffness.

The underlying problem of the invention is solved in that the slider is of square cross-section and the axis of the screw spindle is arranged precisely in the center of the square cross-section, wherein the guide surfaces which are provided at the four sides of the slider and the guide tracks of the housing, which co-operate with the guide surfaces, form tangents to a common circle, the center point of which is the axis of the screw spindle.

In normal operation the novel parallel vice can be used like a conventional, forwardly opening parallel vice. If however the vice is to be used for clamping workpieces whose dimensions are greater than the maximum width of clamping of the vice, then the slider can be drawn completely out of the guide means of the housing, turned through 90° about the axis of the screw spindle and refitted into the guide means in the housing. By virtue of the square cross-section, the slider is then also guided precisely in the housing, in that position. However the movable clamping jaw is now no longer disposed opposite to the fixed clamping jaw but at one side of the housing. The workpiece to be clamped can then be put on to the workpiece beside the housing and can be brought to bear against a support means or co-operating jaw member which is fixed to or can be fixed to the workbench. The workpiece can now be clamped fast between the movable clamping jaw and the support means or the co-operating jaw by means of the movable clamping jaw which projects beyond the side surface of the housing.

The slider desirably is of a cross-section which is closed on all sides and which is only open rearwardly. By virtue of that arrangement the slider has optimum bending and torsional strength in any direction. In addition the screw spindle, in its operative position, is completely surrounded by the slider or the housing and is thus protected from fouling and damage.

BRIEF DESCRIPTION OF THE DRAWINGS

The invention is described in greater detail hereinafter with reference to an embodiment illustrated in the drawings in which.

DETAILED DESCRIPTION

Figure 1:
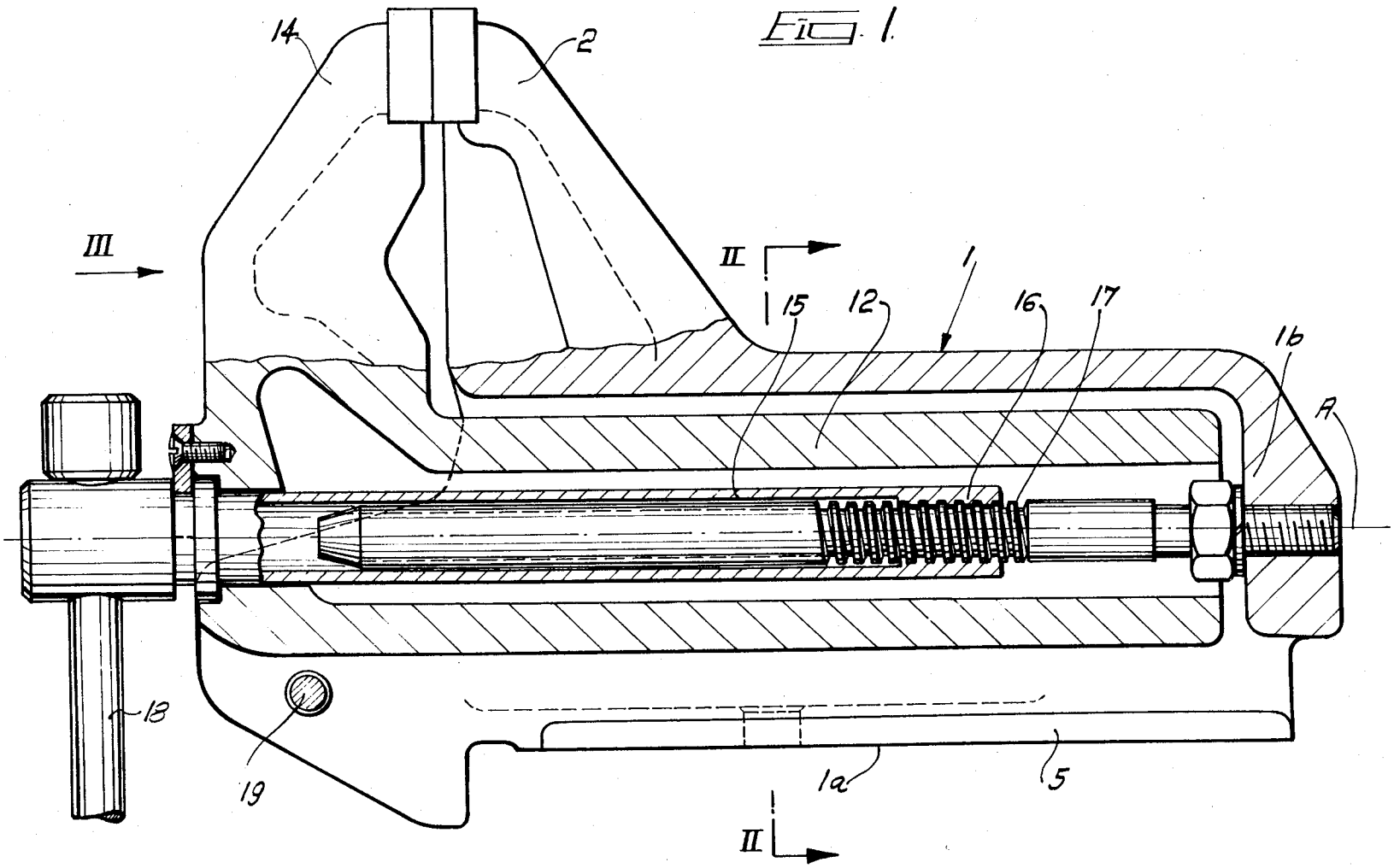
FIG. 1 is a view of the parallel vice in longitudinal section taken along line I—I in FIG. 3.

The housing 1 carries the stationary clamping jaw 2 and can be supported by means of its base surface 1*a* on a workbench 3 or another suitable support arrangement, for example the carrier plate member of a vice lift apparatus (positioning apparatus). For the purposes of fixing the vice in position, the housing 1 has laterally projecting lugs 4 through which screws can be passed in known fashion.

However fixing of the vice may also advantageously be effected by virtue of the downwardly open housing 1 being provided in its lower part, at its two longitudinal sides, with respective inwardly projecting bar portions 5 which extend parallel to the axis A of the screw spindle. The two bar portions 5 form a downwardly open groove of substantially T-shaped cross-section. A holding plate 6, 6' can engage into the groove.

The holding plate 6 may have two bores through which are passed the screws 7 which extend through the workbench 3. By tightening the nuts 8, the housing 1 can be securely connected to the workbench 3. Conversely, the clamping action of the holding plate 6 can be released by slackening the nuts, without the nuts having to be completely unscrewed from the screws 7, so that the housing 1 can then be withdrawn forwardly from the bench. That is advantageous for example when the vice is used on building sites. When a respective piece of work has been completed, the vice can then be removed from the workbench and stored in a secure place.

Figure 3:
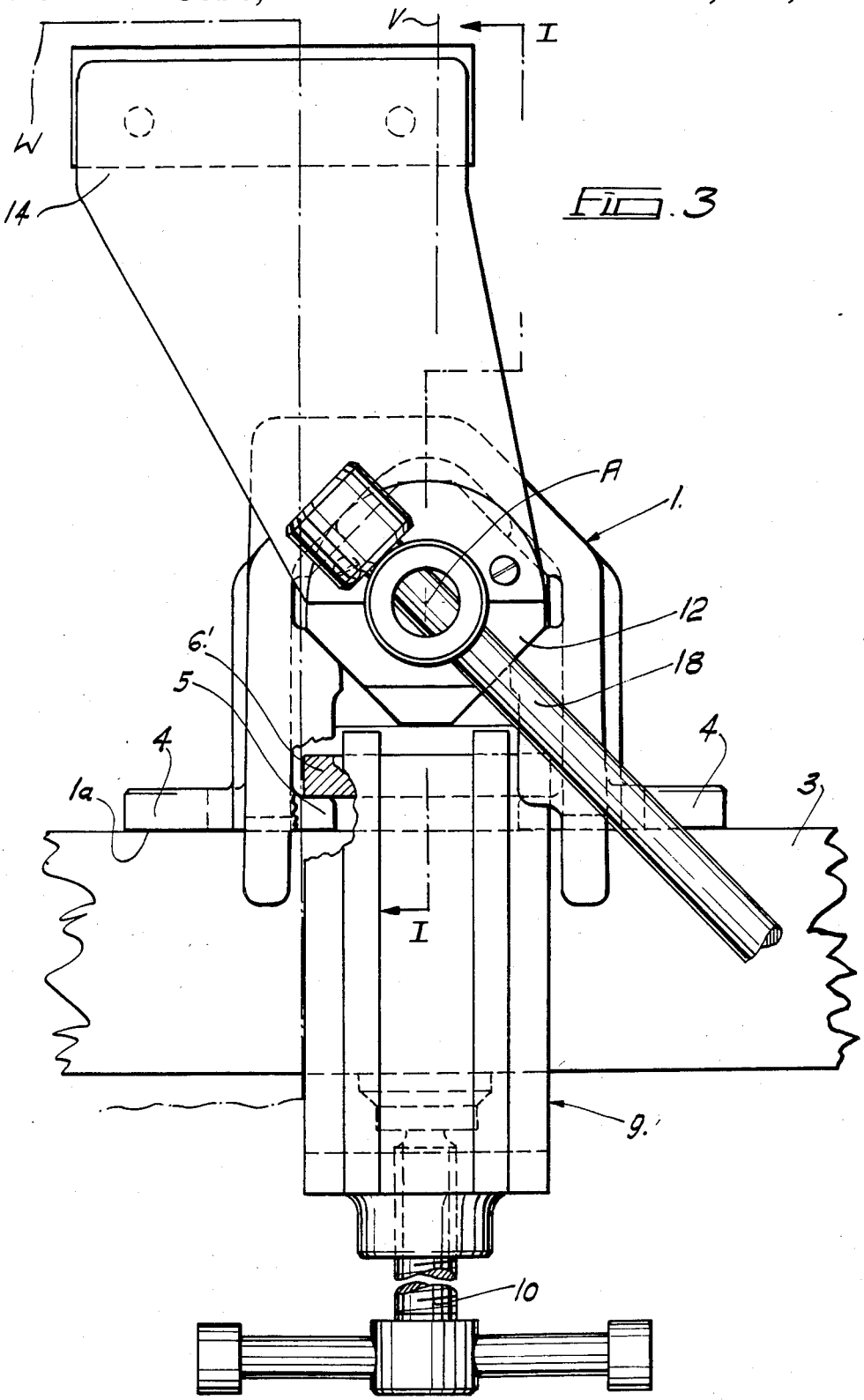
FIG. 3 is a front view in the direction indicated at III in FIG. 1.

It would also be possible to envisage arranging the holding plate 6' on a U-shaped member which is formed in the manner of a screw clamp, as shown in FIG. 3. In that case the holding plate 6' forms one limb of the U-shape configuration of the U-shaped member. The housing 1 can then be releasably connected to the workbench 3 by means of the spindle 10.

Figure 2:
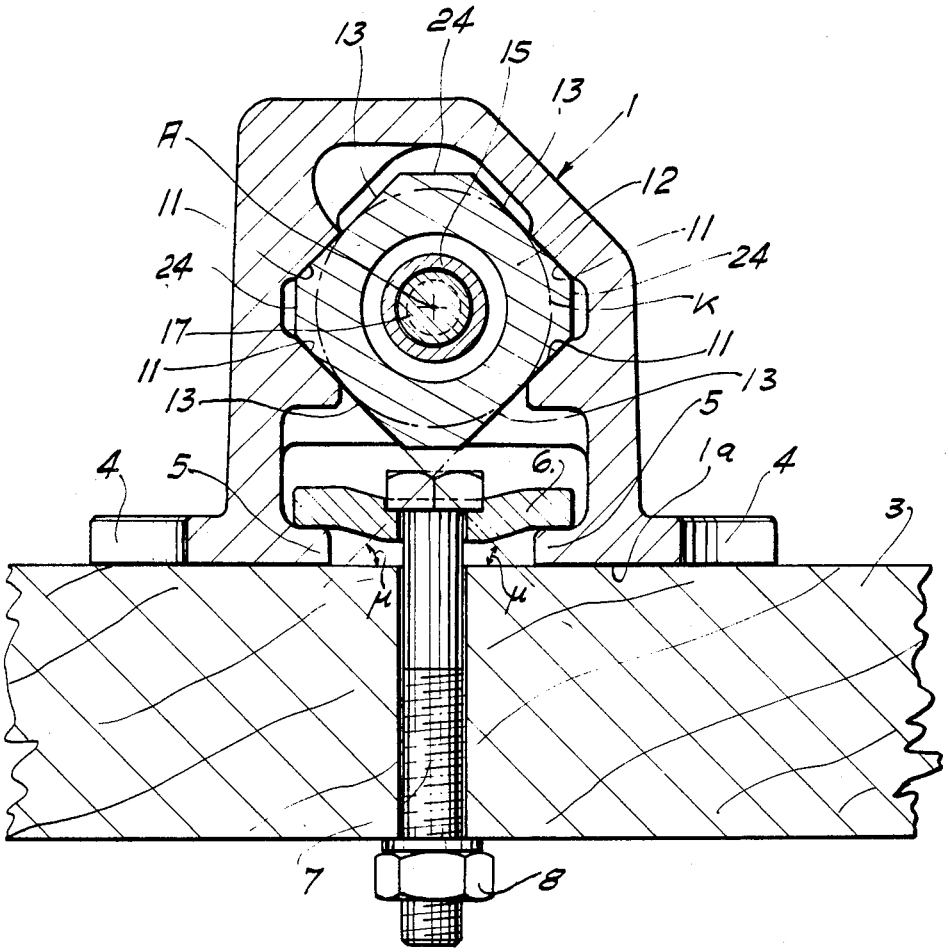
FIG. 2 is a view in cross-section taken along line II—II in FIG. 1.

As can be further seen in particular from FIG. 2, the housing 1 has four guide tracks 11 which together form a quadrangular guide means for the slider 12. The guide tracks 11 extend parallel to the axis A of the screw spindle and form tangents to a circle K whose centerpoint is the axis A of the screw spindle.

The slider 12 is of a square cross-section, the guide surfaces 13 delimiting that cross-section. The axis A of the screw spindle is arranged precisely at the centre of the square cross-section. The guide surfaces which are provided at the four sides of the slider 12 also form tangents to the common circle K whose centerpoint is the axis A of the screw spindle. The slider 12 carries the movable clamping jaw 14. In addition, a screw spindle-nut assembly 15–17 is provided in the hollow slider 12. The sleeve 15 is mounted rotatably but axially immovably in the slider 12 and is rotatable by means of the tommy bar 18. At its inner end, the sleeve 15 carries the nut 16 which embraces the spindle 17 which is fixed with its rearward end to the rear wall **1*b* of the housing 1. For that purpose the housing 1 is extended rearwardly to such a distance that when the clamping jaws 2 and 14 are closed, the housing completely encloses the slider 12. The housing 1 is additionally stiffened at its rearward end by the rear wall 1*b***.

Provided at the forward end of the housing 1 is a transverse screw member 19 which holds the housing 1 together in the forward lower region thereof and thus enhances its strength and stability. The transverse screw member 19 further serves for adjusting the guide tracks 11.

The slider 12 is desirably closed on all sides, except for a rearward opening through which the screw spindle 17 extends. That provides that the slider 12 enjoys optimum rigidity.

So that the guide tracks 11 of the housing can be easily machined, the housing 1 is desirably open downwardly.

In that connection, it is a matter of particular advantage for the slider 12 to be of the cross-section of a square standing on a corner, and accordingly the guide surfaces 13 and the guide tracks 11 are also inclined at an angle $\mu$ of 45° in each case, relative to the base surface 1a of the housing. BY virtue of that arrangement, and by virtue of the downwardly open configuration of the housing 1, it is possible for the guide tracks 11 to be machined in a highly rational manner by means of a gang cutter. In addition, arranging the square cross-section in such a way that it stands on a corner is the optimum arrangement in regard to strength from the point of view of the most frequent loading, namely laterally clamping a workpiece. In addition that arrangement of the square cross-section gives the advantage that no turnings or cuttings or chips remain lying on the inclined guide surfaces 13.

As can be further seen from FIG. 2, between each two adjacent guide surfaces 13 which extend normal to each other, the slider 12 has a respective flat portion 24 which includes an angle of 135° with each of the adjoining guide surfaces 13. The flat portions 24 each extend horizontally and vertically respectively. By virtue of the flat portions 24, the workpiece when being clamped can be laid on to the slider without the guides 13 being damaged. That arrangement also provides a gain in respect of depth of clamping and usable space when laterally (vertically) clamping a workpiece. The flat portions 24 and also the inclined guide surfaces 13 further have the advantage that there is no need for additional supports or cover members which would necessitate additional space and increased production cost.

Desirably the clamping jaws 2 and 14 are arranged asymmetrically with respect to a vertical plane V which passes through the axis A of the screw spindle. That arrangement is known per se and, in the normal situation of use of the parallel vice, gives the advantage that, when clamping workpieces which extend past the slider 12 vertically downwardly, a greater depth of clamping is achieved. In addition, as will be described hereinafter, that arrangement gives particular advantages when clamping workpieces whose dimensions are greater than the maximum width of clamping of the parallel vice.

Figure 5:
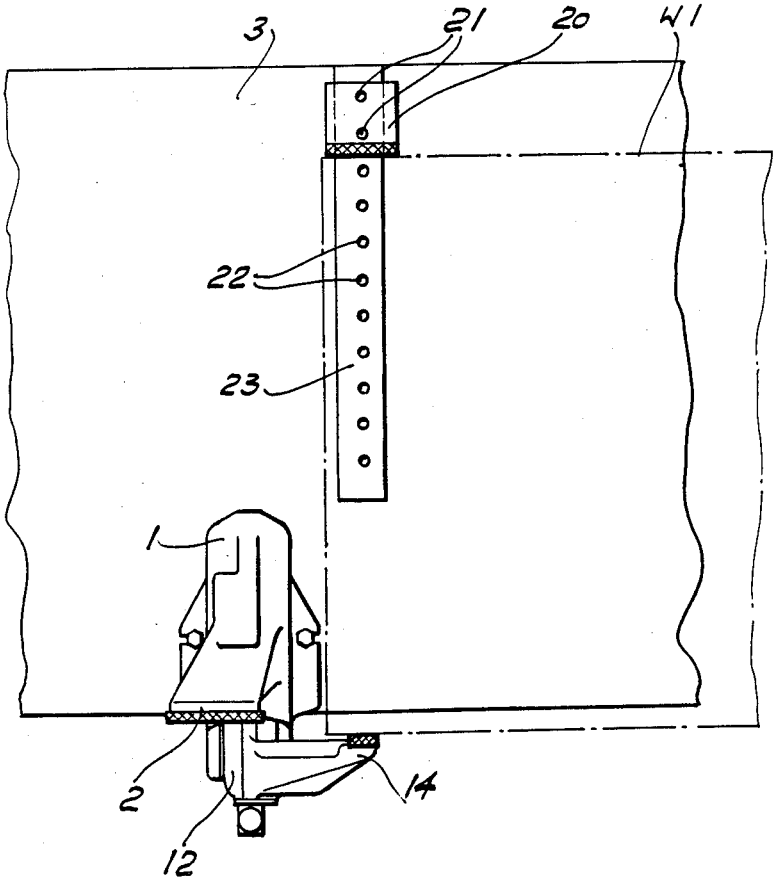
FIG. 5 is a plan view in the direction indicated by V in FIG. 4.
Figure 6:
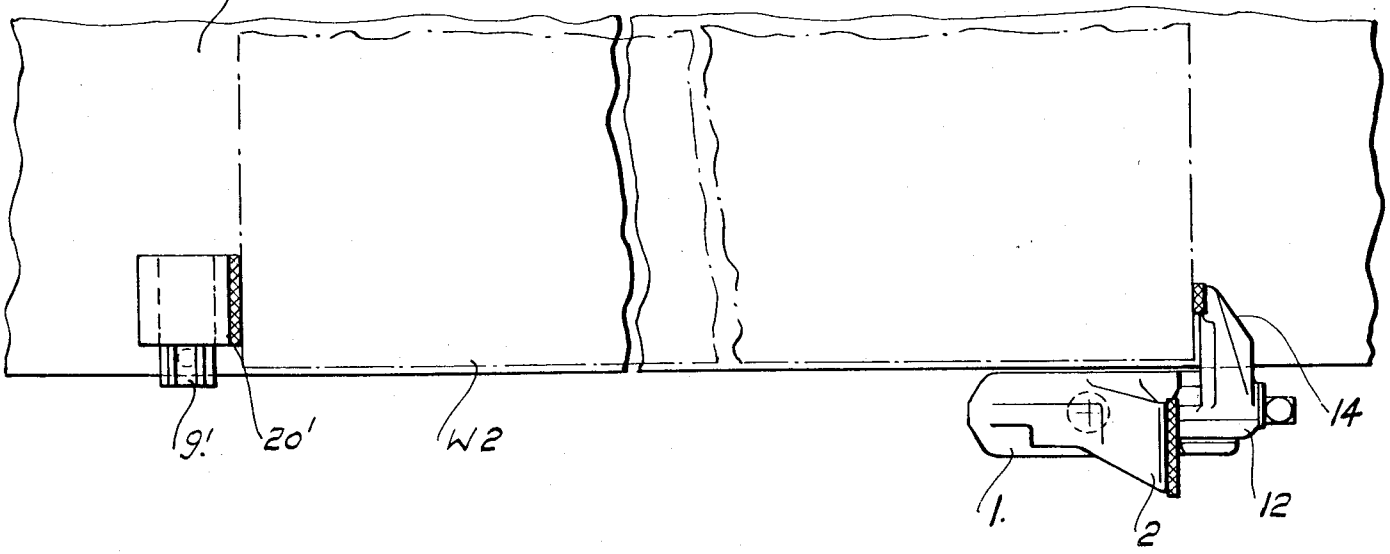
FIG. 6 is a further plan view of the parallel vice in another clamping position.

As can be seen from FIGS. 5 and 6, there is also provided a loose co-operating jaw member 20 and 20' which is provided with holding means for releasably fixing it to the workbench 3 or the like. The co-operating jaw member 20 may have for example holding pins 21 (see FIG. 5) which can be selectively fitted into different bores 22 in a holding bar which is connected to the workbench 3.

When workpieces whose cross-section to be clamped is no greater than the maximum width of clamping of the vice are to be clamped thereby, then the vice is used like a conventional vice, that is to say the two clamping jaws 2 and 14 are arranged in mutually opposite relationship. As can be seen from FIG. 3, by virtue of the asymmetric arrangement of the clamping jaws 2 and 14, the vice can also be used for satisfactorily clamping workpieces W vertically, the workpieces extending vertically downwardly from the clamping jaws 2 and 14 past the slider 12.

Figure 4:
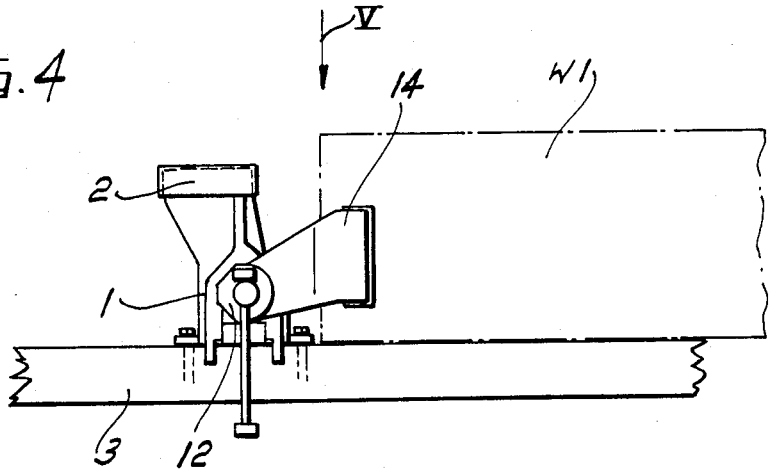
FIG. 4 is a front view of the parallel vice when clamping larger workpieces.

For the purposes of clamping larger workpieces whose clamping cross-section is larger than the maximum width of clamping of the vice, the slider 12 is screwed out entirely in a forward direction by rotating the sleeve 15, and can then be removed in a forward direction from the housing. The slider 12 is then turned through 90° about the axis A of the screw spindle and refitted into the quandrangular guide means of the housing 1. That is readily possible by virtue of the square cross-section of the slider 12 and the corresponding arrangement of the guide tracks 11 of the housing. The clamping jaw 14 of the slider 12 then occupies the position shown in FIGS. 4 and 5. For the purposes of clamping the larger workpiece W1, the workpiece is laid on to the workbench 3 and the co-operating jaw member 20 is secured to the appropriate location on the holding bar 23. The workpiece W1 can then be clamped fast between the jaw member 20 and the movable clamping jaw 14. The asymmetric arrangement of the stationary clamping jaw 2 provides that it is not in the way in such clamping operations.

When the parallel vice, as shown in FIG. 6, is fixed on what is referred to as a stroke lift apparatus which permits not only raising and lowering of the vice but also pivotal movement thereof about a vertical axis, then it is also possible to clamp workpieces W2 whose clamping cross-section is greater than the depth of the workbench 3. For that purpose the vice is pivoted about the vertical axis of the lift apparatus and moved into the position shown in FIG. 6. The movable co-operating jaw member 20' is then fixed to the workbench at the appropriate location. That may be effected for example by a screw clamp-like stirrup member 9' which is of the same kind of configuration as the member 9 shown in FIG. 3. Instead of the co-operating jaw member being fixed in that way it would also be possible to use the arrangement illustrated in FIG. 5, in which case of course the holding bar 23 would then have to extend parallel to the longitudinal edge of the workbench 3.

I claim:

1. A forwardly opening parallel vice comprising a housing adapted to be fixed to a workbench or the like and which carries a stationary clamping jaw and which has a quandrangular guide means, and a hollow slider which is displaceable in said guide means and which bears with a plurality of guide surfaces against guide tracks of said quadrangular guide means and carries said movable clamping jaw, and a screw spindle nut assembly which is provided in said slider, of which one part is mounted rotatably and axially immovably in said slider and the other part is fixed to said housing, said slider being of square cross-section standing on one of its corners and an axis of a screw spindle is arranged precisely at a center of said square cross-section, wherein said guide surfaces which are provided at the four sides of said slider and said guide tracks of said housing which co-operate with said guide surfaces form tangents to a common circle whose centerpoint is the axis of the screw spindle and wherein said guide surfaces and said guide tracks are inclined at an angle of 45° in each case relative to a base surface of said housing.

2. A vice according to claim 1, wherein said slider is of a cross-section which is closed on all sides and only opens rearwardly.

3. A vice according to claim 1, wherein said housing is extended rearwardly to such an extent that when said clamping jaws are closed said housing completely encloses said slider, and wherein said housing has a rear wall to which said screw spindle is fixed.

4. A vice according to claim 1, wherein said housing is open downwardly.

5. A vice according to claim 4, wherein provided in the lower part of the housing at each of said two longitudinal sides thereof is a respective inwardly projecting bar portion which extends parallel to the axis said of screw spindle, said bar portions serving to form a downwardly open groove of substantially T-shaped cross-section, for engagement of a holding plate therein.

6. A vice according to claim 5, wherein said holding plate is a limb portion of a U-shape of a substantially U-shaped, screw clamp-like stirrup member.

7. A vice according to claim 1, wherein said slider has a respective flat portion between each two adjacent guide surfaces which extend normal to each other, each flat portion including an angle of 135° with the respective adjoining guide surfaces.

8. A vice according to claim 1, wherein said clamping jaws are arranged asymmetrically with respect to a vertical plane passing through the axis of said screw spindle.

9. A vice according to claim 1, wherein there is provided a loose co-operating jaw member which is provided with holding means for releasably fixing it to a workbench or the like.

10. A vice according to claim 9, wherein as said holding means said co-operating jaw member has holding pins which can be selectively fitted into different bores in a holding bar which can be fixedly connected to the workbench or the like.

11. A vice according to claim 9, wherein a screw clamp is provided as said holding means for said co-operating jaw member.

* * * * *